US012203675B2

(12) United States Patent
Lin

(10) Patent No.: US 12,203,675 B2
(45) Date of Patent: Jan. 21, 2025

(54) PANEL ASSEMBLY OF CEILING-EMBEDDED AIR CONDITIONER AND CEILING-EMBEDDED AIR CONDITIONER HAVING THE SAME

(71) Applicant: GD MIDEA AIR-CONDITIONING EQUIPMENT CO., LTD., Foshan (CN)

(72) Inventor: Chao Lin, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 385 days.

(21) Appl. No.: 17/765,320

(22) PCT Filed: Nov. 26, 2019

(86) PCT No.: PCT/CN2019/120869
§ 371 (c)(1),
(2) Date: Mar. 30, 2022

(87) PCT Pub. No.: WO2021/082142
PCT Pub. Date: May 6, 2021

(65) Prior Publication Data

US 2022/0333815 A1 Oct. 20, 2022

(30) Foreign Application Priority Data

Oct. 31, 2019 (CN) ..... 201921863229.2

(51) Int. Cl.
*F24F 13/08* (2006.01)
*F24F 13/14* (2006.01)

(52) U.S. Cl.
CPC ..... *F24F 13/082* (2013.01); *F24F 13/1413* (2013.01); *F24F 2221/14* (2013.01)

(58) Field of Classification Search
CPC ... F24F 13/082; F24F 13/1413; F24F 2221/14
(Continued)

(56) References Cited

U.S. PATENT DOCUMENTS 5,577,958 A * 11/1996 Kumekawa ..... F24F 13/081 454/304
9,897,335 B2 * 2/2018 Nouchi ..... F24F 1/0047
(Continued)

FOREIGN PATENT DOCUMENTS

CN 107830579 A 3/2018
CN 108006818 A 5/2018
(Continued)

OTHER PUBLICATIONS

World Intellectual Property Organization (WIPO) International Search Report and Written Opinion for PCT/CN2019/120869 May 9, 2020 22 Pages (with translation).
(Continued)

*Primary Examiner* — Avinash A Savani
*Assistant Examiner* — Dana K Tighe
(74) *Attorney, Agent, or Firm* — Anova Law Group, PLLC

(57) ABSTRACT

A panel assembly includes a panel, a panel frame, and an air guide plate. The panel frame is in annular shape and fitted over the panel. The panel frame includes a plurality of air outlets spaced apart from each other and surrounding the panel, and an air baffle rib provided at an appearance surface of the panel frame and located on a side of the air outlets away from the panel. The air guide plate is movably arranged at the air outlets.

20 Claims, 4 Drawing Sheets

(58) Field of Classification Search
USPC ..... 454/237
See application file for complete search history.

(56) References Cited

U.S. PATENT DOCUMENTS

| | | | | |
|---|---|---|---|---|
| 10,288,302 | B2 * | 5/2019 | Fujita | F24F 13/30 |
| 11,408,618 | B2 * | 8/2022 | Iwase | F24F 13/30 |
| 2006/0276123 | A1 * | 12/2006 | Sanagi | F24F 1/0047<br>454/299 |
| 2008/0034775 | A1 * | 2/2008 | Choi | F24F 1/0014<br>62/259.1 |
| 2018/0313569 | A1 | 11/2018 | Moon et al. | |

FOREIGN PATENT DOCUMENTS

| | | | |
|---|---|---|---|
| CN | 208011911 | U | 10/2018 |
| EP | 1589292 | A1 | 10/2005 |
| EP | 2589887 | A1 | 5/2013 |
| EP | 3163177 | A1 | 5/2017 |
| EP | 3184925 | A1 | 6/2017 |
| JP | 2000283544 | A | 10/2000 |
| JP | 2007322103 | A | 12/2007 |
| KR | 20180113734 | A | 10/2018 |

OTHER PUBLICATIONS

The European Patent Office (EPO) Extended Search Report for EP Application No. 19950471.3 Sep. 27, 2022 8 Pages.

* cited by examiner

PANEL ASSEMBLY OF CEILING-EMBEDDED AIR CONDITIONER AND CEILING-EMBEDDED AIR CONDITIONER HAVING THE SAME

CROSS-REFERENCE TO RELATED APPLICATION APPLICATIONS

The present application is a National Stage Entry under 35 U.S.C. § 371 of International Application No. PCT/CN2019/120869, filed on Nov. 26, 2019, which is based upon and claims priority to Chinese Patent Application No. 201921863229. 2, filed on Oct. 31, 2019, the entire contents of both of which are incorporated herein by reference.

TECHNICAL FIELD

The present disclosure relates to a technical field of household appliances, and more particularly to a panel assembly of a ceiling-embedded air conditioner and a ceiling-embedded air conditioner having the same.

BACKGROUND

In a related art, a panel assembly of a ceiling-embedded air conditioner is provided with air outlets. In some panel assemblies, condensate water easily accumulates near an air outlet, resulting in water blowing or dripping of the condensate water, causing poor user experience.

SUMMARY

The present disclosure aims to solve at least one of the technical problems existing in the related art. Therefore, the present disclosure provides a panel assembly of ceiling-embedded air conditioner to improve comfort experience for user.

The present disclosure provides a ceiling-embedded air conditioner having the above panel assembly to improve the comfort experience for user.

The panel assembly of the ceiling-embedded air conditioner according to the embodiments of the present disclosure includes a panel; a panel frame in annular shape and fitted over the panel, the panel frame being provided with a plurality of air outlets spaced apart from each other and surrounding the panel, an appearance surface of the panel frame being provided with an air baffle rib, and the air baffle rib being located on a side of the air outlet away from the panel; and an air guide plate movably arranged at the air outlet.

The panel assembly of the ceiling-embedded air conditioner according to the embodiments of the present disclosure is provided with the air guide plate to adjust an air supply direction of the panel assembly. For example, the air guide plate may be moved to a direction parallel to a plane where the panel is located, such that the panel assembly may output air radially. In another example, the air guide plate may be moved to a direction perpendicular to a plane where the panel is located, such that the panel assembly may output air axially. For yet another example, the air guide plate may be moved to a direction at an acute angle to a plane where the panel is located, such that the panel assembly may output air laterally. In this way, the panel assembly has a variety of air-output manners, which may meet multiple needs of users. The air baffle rib may block the airflow at the air outlet from directly blowing to the appearance surface of the panel frame, so as to reduce the condensate water formed on the panel frame, reduce the problems such as water blowing or dripping of the condensate water, and improve the comfort experience for user. In addition, the air baffle rib may also improve mechanical strength of the panel frame and improve a fatigue life of the panel assembly.

In some embodiments, the panel frame includes: a first panel frame, the first panel frame is in annular shape and fitted over an outer circumference of the panel, and a plurality of notches spaced apart from each other are arranged at an outer edge of the first panel frame; and a second panel frame, the second panel frame is in annular shape and fitted over an outer circumference of the first panel frame, the air outlet is formed between an inner wall of each notch and an inner peripheral wall of the second panel frame, and the air baffle rib is arranged at the second panel frame.

In some embodiments, each air outlet is provided with at least one air guide plate rotatable to open and close, and a rotation shaft of the air guide plate is located on a side of the air outlet adjacent to the panel.

In some embodiments, a plurality of air baffle ribs are provided to be spaced apart from each other at a side of the air outlet away from the panel.

In some embodiments, a width dimension of the air baffle rib is less than or equal to 3 mm, and a spacing between the adjacent air baffle ribs is less than or equal to 5 mm.

In some embodiments, the air baffle ribs are in a ring shape surrounding the panel, and the air baffle ribs surrounds an outer side of the plurality of air outlets.

In some embodiments, the air guide plate is provided with a windless-feeling perforation.

In some embodiments, the panel is provided with an air inlet.

In some embodiments, the panel is integrated with an air inlet grille at the air inlet.

The ceiling-embedded air conditioner according to embodiments of the present disclosure includes the panel assembly of the ceiling-embedded air conditioner according to any one of the above embodiments.

The ceiling-embedded air conditioner according to the embodiments of the present disclosure may adjust the air supply direction of the panel assembly via the air guide plate, such that the ceiling-embedded air conditioner may have a variety of air-output modes and may meet the multiple needs of users. The air baffle rib may block the airflow at the air outlet from blowing directly to the appearance surface of the panel frame, so as to reduce the condensate water easily formed on the appearance surface, reduce the problems such as water blowing or dripping of the condensate water, and improve the comfort experience for user. In addition, the air baffle rib may also improve the mechanical strength of the panel frame and improve the fatigue life of the ceiling-embedded air conditioner.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and readily appreciated from the following descriptions made with reference to the drawings, in which.

Figure 1:
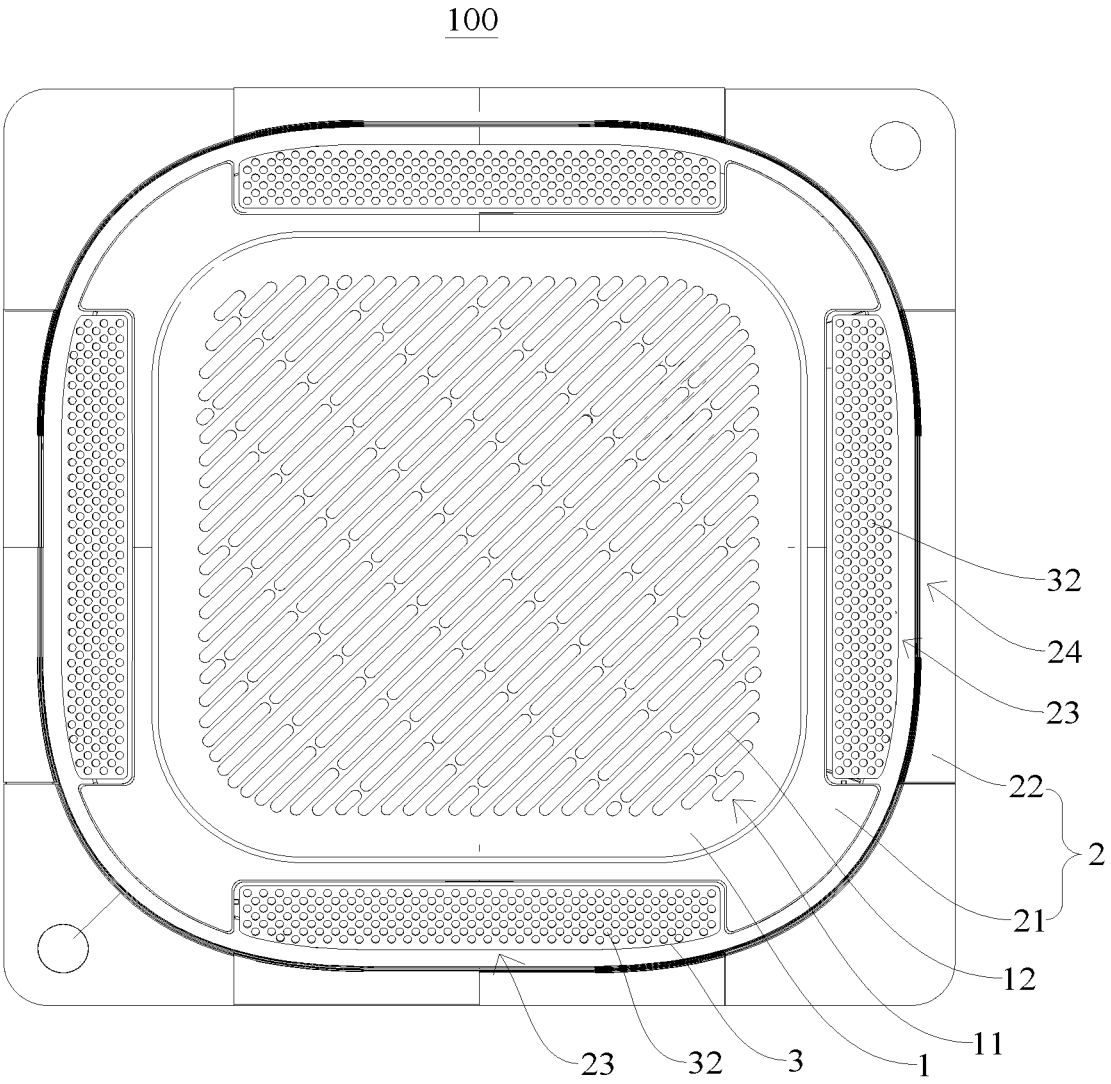
FIG. 1 is a schematic view of a panel assembly in an embodiment of the present disclosure.

REFERENCE NUMERALS ceiling-embedded air conditioner 1000
panel assembly 100
panel 1, air inlet 11, air inlet grille 12
panel frame 2, first panel frame 21, second panel frame 22, air outlet 23, air baffle rib
air guide plate 3, rotation shaft 31, windless-feeling perforation 32
body 200.

DETAILED DESCRIPTION

Embodiments of the present disclosure are further described. Examples of the embodiments are illustrated in the accompanying drawings. Same or similar reference signs represent the same or similar components or components that have the same or similar functions from beginning to end. The embodiments described below with reference to the accompanying drawings are exemplary, are merely used to explain the present disclosure, and cannot be construed as a limitation to the present disclosure.

In the specification of the present disclosure, it is to be understood that, terms such as "upper," "lower," "vertical," "horizontal," "inner," "outer," "axial," "radial" indicate the orientation or position relationship based on the orientation or position relationship illustrated in the drawings only for convenience of description or for simplifying description of the present disclosure, and do not indicate or imply that the device or element referred to must have a particular orientation or be constructed and operated in a specific orientation, and hence cannot be construed as limitation to the present disclosure. In addition, a feature associated with "first" and "second" may comprise one or more of this feature. In the description of the present disclosure, the term "a plurality of" means two or more than two, unless specified otherwise.

In the present disclosure, it should be noted that, unless specified otherwise, terms "mounted," "coupled," and "connected," are used broadly, for example, may be fixed connections, detachable connections, or integral connections; may also be mechanical or electrical connections; may also be direct connections or indirect connections via intervening structures; may also be inner communications of two elements, which may be understood by those skilled in the related art according to specific situations.

The panel assembly 100 of the ceiling-embedded air conditioner according to embodiments of the present disclosure is described below with reference to FIGS. 1-3.

Figure 2:
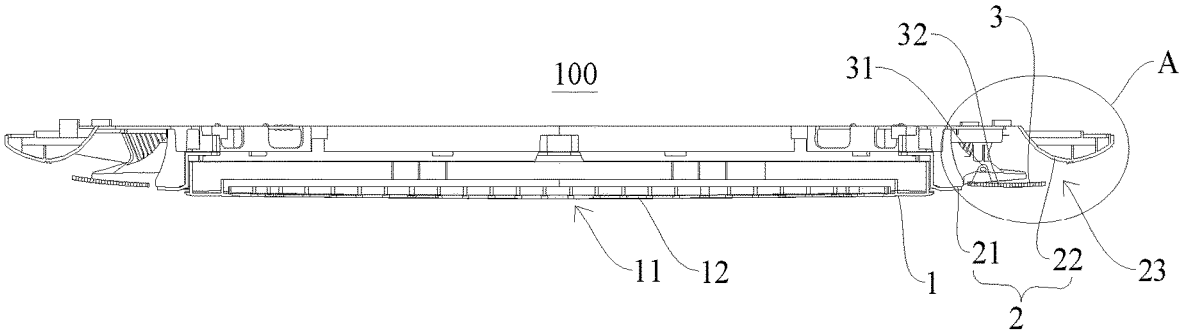
FIG. 2 is a sectional view of a panel assembly in an embodiment of the present disclosure.
Figure 3:
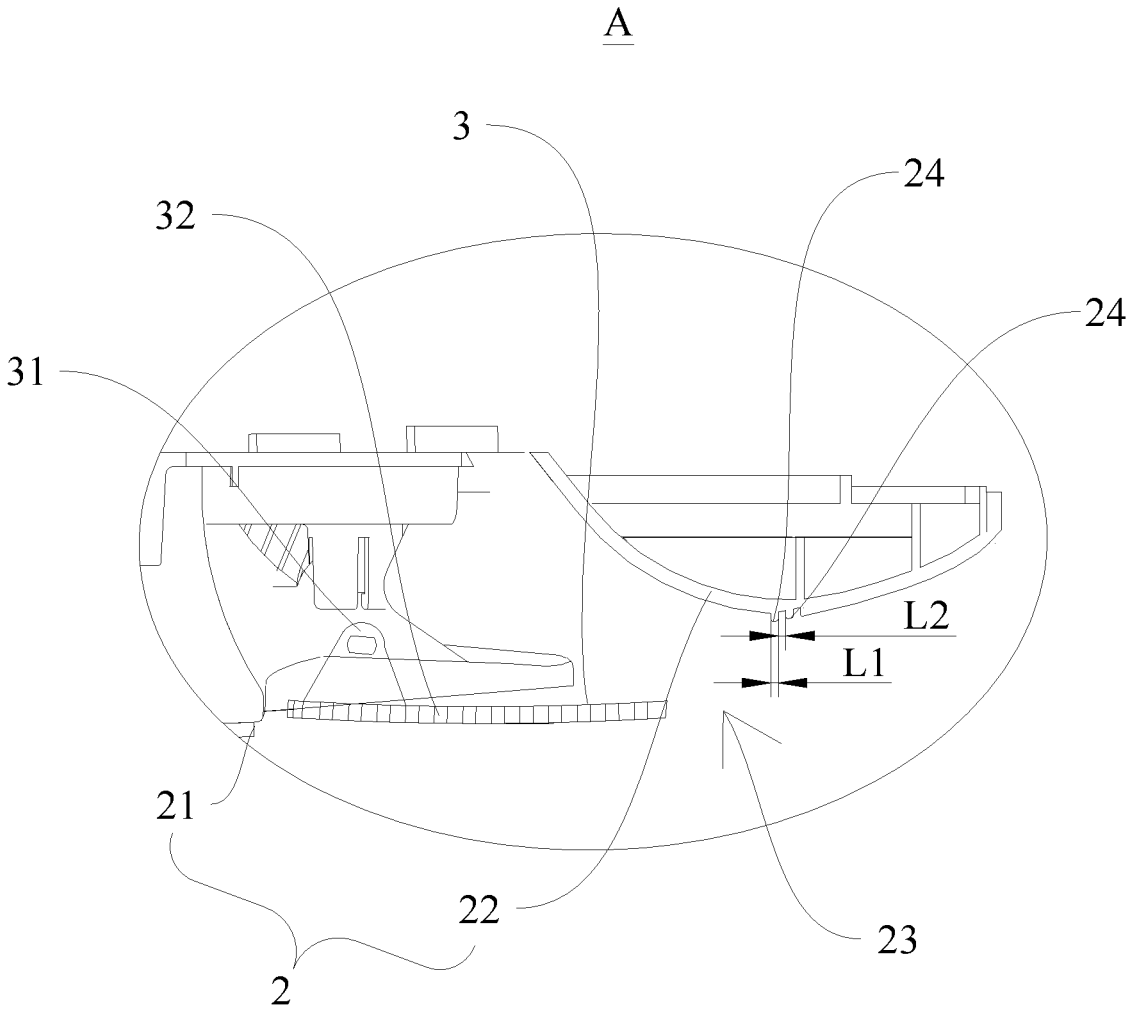
FIG. 3 is a partially enlarged view of part A in FIG. 2.

As shown in FIGS. 1 to 3, the panel assembly 100 of the ceiling-embedded air conditioner according to the embodiments of the present disclosure includes a panel 1, a panel frame 2 and an air guide plate 3. The panel frame 2 is in annular shape, the panel frame 2 is fitted over the panel 1, the panel frame 2 is provided with a plurality of air outlets 23 are spaced apart from each other and surround the panel 1, an appearance surface of the panel frame 2 is provided with an air baffle rib 24, and the air baffle rib 24 is located on a side of the air outlet 23 away from the panel 1. The air guide plate 3 is movably arranged at the air outlet 23.

It may be understood that the panel frame 2 may fix and limit the panel 1 to improve the mounting stability of the panel 1. The panel frame 2 may be further formed with a plurality of air outlets 23 spaced apart from each other, so as to improve air supply effect of the panel assembly 100.

As shown in FIG. 2, the air guide plate 3 may adjust an air supply direction of the panel assembly 100. For example, the air guide plate 3 may be moved to a direction parallel to a plane where the panel 1 is located, such that the panel assembly 100 may output air radially. In another example, the air guide plate 3 may be moved to a direction perpendicular to a plane where the panel 1 is located, such that the panel assembly 100 may output air axially. For example, the air guide plate 3 may be moved to a direction at an acute angle to a plane where the panel 1 is located, such that the panel assembly 100 may output air laterally. In this way, the panel assembly 100 has a variety of air-output manners, which may meet multiple needs of users. It should be noted that the air guide plate 3 may be an arc surface, and a positional relationship between the air guide plate 3 and the panel 1 refers to a relationship between a tangent of an inner arc surface of the air guide plate 3 and a plane where the panel 1 is located. The air guide plate 3 may also be a flat-straight plane, and a positional relationship between the air guide plate 3 and the panel 1 refers to a relationship between a plane where the air guide plate 3 is located and a plane where the panel 1 is located.

During practical use, when a short-time use is needed, user may choose a lateral air-output mode or axial air-output mode, such that the supplied airflow is close to the user as much as possible, thereby quickly providing a comfortable temperature for the user. When a long-time use is needed by the user, the radial air-outlet mode may be used to reduce user's physical discomfort, such as headache, nasal congestion and other air conditioning diseases, caused by the supplied airflow directly blowing to the user.

As shown in FIG. 3, the air baffle rib 24 may block the airflow at the air outlet 23 from directly blowing to the appearance surface of the panel frame 2, so as to reduce the condensate water formed on the panel frame 2, reduce the problems such as water blowing or dripping of the condensate water, and improve the comfort experience for user. For example, in some panel assemblies, the appearance surface of the panel is a smooth surface, and the airflow at the air outlet directly blows to the appearance surface of the panel frame, which easily causes the condensate water formed on the appearance surface. In the panel assembly 100 of the present disclosure, the air baffle rib 24 may reduce the occurrence of such situation. In addition, the air baffle rib 24 may also improve mechanical strength of the panel frame 2 and improve a fatigue life of the panel assembly 100.

According to the panel assembly 100 of the ceiling-embedded air conditioner according to the embodiments of the present disclosure, the air supply direction of the panel assembly 100 may be adjusted through the air guide plate 3, such that the panel assembly 100 may have a variety of air-output modes and may meet the multiple needs of users. The air baffle rib 24 may block the airflow at the air outlet 23 from blowing directly to the appearance surface of the panel frame 2, so as to reduce the condensate water easily formed on the appearance surface, reduce the problems such as water blowing or dripping of the condensate water, and improve the comfort experience for user. In addition, the air baffle rib 24 may also improve the structural strength of the panel frame 2 and improve the fatigue life of the panel assembly 100.

In some embodiments, as shown in FIGS. 1 and 2, the panel frame 2 includes a first panel frame 21 and a second panel frame 22. The first panel frame 21 is in annular shape, the first panel frame 21 is fitted over an outer circumference of the panel 1, and a plurality of notches spaced apart from each other are arranged at an outer edge of the first panel frame 21. The second panel frame 22 is in annular shape, the second panel frame 22 is fitted over an outer circumference of the first panel frame 21, the air outlet 23 is formed between an inner wall of each notch and an inner peripheral wall of the second panel frame 22, and the air baffle rib 24 is arranged at the second panel frame 22. It may be understood that the first panel frame 21 may fix and limit the panel 1 and improve the mounting stability of the panel 1. The first panel frame 21 may also be formed with a plurality of notches spaced apart from each other on an outer edge of the first panel frame, so as to improve air volume of the air passing through the first panel frame 21 and improve the air supply efficiency of the panel assembly 100. Moreover, an inner wall of each notch may further guide the flow of airflow.

The second panel frame 22 may fix and limit the first panel frame 21, so as to improve the mounting stability of the first panel frame 21. The second panel frame 22 may further guide the flow of airflow, such that the air flows along an inner peripheral wall of the second panel frame 22.

In addition, the panel frame 2 includes the first panel frame 21 and the second panel frame 22, which may improve the structural strength of the panel frame 2, facilitate the molding of the panel 1 and help to reduce the cost.

In some embodiments, as shown in FIG. 1 and FIG. 2, each air outlet 23 is provided with at least one air guide plate 3 rotatable to open and close, and a rotation shaft 31 of the air guide plate 3 is located on a side of the air outlet 23 adjacent to the panel 1. It may be understood that the air guide plate 3 may rotate around the rotation shaft 31, so as to change an inclined direction of the air guide plate 3 of the rotation shaft 31, and then to change the air-output direction of the panel assembly 100. The rotation shaft 31 is located on the side of the air outlet 23 adjacent to the panel 1, such that when the air guide plate 3 is rotated to be parallel to the plane where the panel 1 is located, the panel assembly 100 may output air radially, which may reduce the discomfort caused by long time direct blowing to the user.

Of course, in some other embodiments, the air guide plate 3 may also be arranged to be slidable to open and close, the arrangement may also achieve the above functions, and action manners of the air guide plate 3 is not limited herein.

In some embodiments, as shown in FIG. 3, a plurality of air baffle ribs 24 are spaced apart from each other at a side of the air outlet 23 away from the panel 1. It may be understood that temperature difference between the side of the air outlet 23 away from the panel 1 and the airflow is large, and when the airflow blows to this side, it is easy to form the condensate water. Therefore, the plurality of air baffle ribs 24, spaced apart from each other, is arranged at this side, so as to block the airflow and reduce the direct blowing of the airflow to this side.

Of course, in some other embodiments, the plurality of spaced air baffle ribs 24 may also be arranged at a side of the air outlet 23 close to the panel 1, so as to further reduce the water blowing and improve the comfort experience for user.

Specifically, as shown in FIG. 3, a width dimension of the air baffle rib 24 (denoted by L1) is less than or equal to 3 mm, and a spacing between adjacent air baffle ribs 24 (denoted by L2) is less than or equal to 5 mm. It should be noted that a blocking effect of the air baffle rib 24 on the airflow refers to blocking the airflow from blowing directly to the panel frame 2, rather than blocking the airflow from flowing out of the air outlet 23. The width dimension of the air baffle rib 24 is less than or equal to 3 mm, and the spacing between adjacent air baffle ribs 24 is less than or equal to 5 mm. Thus, the air baffle rib 24 may well prevent the airflow from directly blowing to the panel frame 2, which has little impact on that the airflow flows out of the air outlet 23, so as to reduce a flow loss of the airflow.

In some embodiments, as shown in FIG. 1, the air baffle ribs 24 are in annular shape surrounding the panel 1, and the air baffle ribs 24 surrounds an outer side of the plurality of air outlets 23. In this way, the air baffle ribs 24 may block the airflow at the plurality of air outlets 23 from blowing directly to the panel frame 2, reduce the formation of the condensate water as much as possible and improve the user experience.

Optionally, the air baffle ribs 24 may be arranged continuously or in sections. That is, the air baffle ribs 24 may surround an entire outside of the panel 1. The air baffle ribs 24 may also only surround the outside of the plurality of air outlets 23, or the air baffle ribs 24 may surround the outside of the plurality of air outlets 23 and surround a part of the outside of the panel 1.

In some embodiments, as shown in FIGS. 1 and 2, the air guide plate 3 is provided with a windless-feeling perforation 32. It may be understood that during operation, the airflow at air outlet 23 is relatively concentrated and the air speed is relatively large. The windless-feeling perforation 32 may disperse the airflow, reduce intensity of the airflow such that the output air is softer and more uniform.

In some embodiments, as shown in FIGS. 1 and 2, the panel 1 is provided with an air inlet 11. It may be understood that the panel frame 2 is fitted over the panel 1, the panel 1 occupies large area, and the air inlet 11 is arranged at the panel 1, which is conducive to improving air volume of input air and improve the air supply efficiency of the panel assembly 100.

Specifically, as shown in FIG. 1 and FIG. 2, the panel 1 is integrated with an air inlet grille 12 at the air inlet 11. It may be understood that the air inlet grille 12 may improve cleanliness of interior of the panel assembly 100, reduce the entry of dust and other particles carried in the airflow into the interior of the panel assembly, so as to improve the service life of the panel assembly 100.

The panel assembly 100 of the ceiling-embedded air conditioner according to a specific embodiment of the present disclosure is described below with reference to FIGS. 1-3.

The panel assembly 100 of the ceiling-embedded air conditioner according to the embodiments of the present disclosure includes a panel 1, a panel frame 2 and an air guide plate 3.

The panel 1 is provided with an air inlet 11, and the panel 1 is integrated with an air inlet grille 12 at the air inlet 11. The panel frame 2 includes a first panel frame 21 and a second panel frame 22. The first panel frame 21 is in annular shape and fitted over an outer circumference of the panel 1, and a plurality of notches spaced apart from each other are provided at an outer edge of the first panel frame 21. The second panel frame 22 is in annular shape and fitted over an outer circumference of the first panel frame 21, the air outlet 23 is formed between an inner wall of each notch and an inner peripheral wall of the second panel frame 22, and two air baffle ribs 24 are spaced apart from each other and arranged at the second panel frame 22. A width dimension of air baffle rib 24 is less than or equal to 3 mm, and a spacing between two air baffle ribs 24 is less than or equal to 5 mm. An air guide plate 3 is rotatable to open and close at each air outlet 23, and a rotation shaft 31 of the air guide plate 3 is located on a side of the air outlet 23 adjacent to the panel 1. The air guide plate 3 is provided with a windless-feeling perforation 32.

A ceiling-embedded air conditioner 1000 according to an embodiment of the present disclosure is described below with reference to the accompanying drawings.

Figure 4:
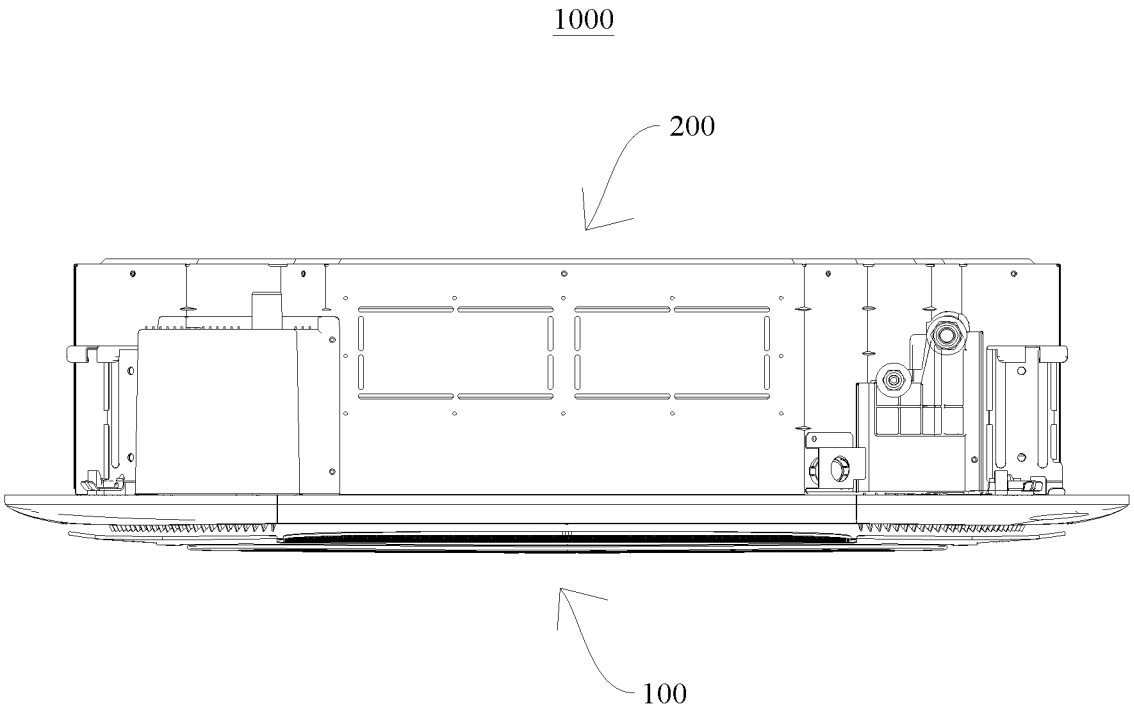
FIG. 4 is a schematic view of a ceiling-embedded air conditioner in an embodiment of the present disclosure.

The ceiling-embedded air conditioner 1000 according to the embodiments of the present disclosure, as shown in FIGS. 2 and 4, includes the panel assembly 100 of the ceiling-embedded air conditioner according to the above embodiments of the present disclosure. The structure of the panel assembly 100 has been described in detail above and is not repeated herein.

The ceiling-embedded air conditioner 1000 according to the embodiments of the present disclosure may adjust the air supply direction of the panel assembly 100 via the air guide plate 3, such that the ceiling-embedded air conditioner 1000 may have a variety of air-output modes and may meet the multiple needs of users. The air baffle rib 24 may block the airflow at the air outlet 23 from blowing directly to the appearance surface of the panel frame 2, so as to reduce the condensate water easily formed on the appearance surface, reduce the problems such as water blowing or dripping of the condensate water, and improve the comfort experience for user. In addition, the air baffle rib 24 may also improve the mechanical strength of the panel frame 2 and improve the fatigue life of the panel assembly 100.

Optionally, as shown in FIG. 4, the ceiling-embedded air conditioner 1000 also includes a body 200 connected to the panel assembly 100. In this way, the body 200 may fix and limit the panel assembly 100 and improve the mounting stability of the panel assembly 100. Of course, the body 200 may also provide other structural mounting positions. Other structures here refer to axial flow fans and electric control boxes, which are known to those skilled in the art and is not described in detail herein.

Reference throughout this specification to "one embodiment," "some embodiments," "schematic embodiment," "an example," "a specific example," or "some examples" means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Furthermore, the particular features, structures, materials, or characteristics may be combined in any suitable manner in one or more embodiments or examples.

Although embodiments of present disclosure have been shown and described above, it should be understood by those skilled in the art that above embodiments are just explanatory, and cannot be construed to limit the present disclosure, changes, modifications, alternatives and variations can be made to the embodiments without departing from the scope of the present disclosure.

What is claimed is:

1. A panel assembly comprising:

a panel;

a panel frame in annular shape and fitted over the panel, the panel frame including:

a plurality of air outlets spaced apart from each other and surrounding the panel; and an air baffle rib provided at an appearance surface of the panel frame and located on a side of the plurality of air outlets away from the panel; and an air guide plate movably arranged at the plurality of air outlets, and including a rotation shaft, the rotation shaft being located at a position lower than a lowermost point of the appearance surface of the panel frame in a vertical direction;

wherein the air baffle rib is configured to prevent airflow outputting radially at one of the plurality of air outlets from directly blowing to the appearance surface of the panel frame in response to the air guide plate moving to a direction parallel to a plane where the panel is located.

2. The panel assembly according to claim 1, wherein the panel frame includes:

a first panel frame in annular shape and fitted over an outer circumference of the panel, a plurality of notches spaced apart from each other being arranged at an outer edge of the first panel frame; and a second panel frame in annular shape and fitted over an outer circumference of the first panel frame, each of the plurality of air outlets being formed between an inner wall of one of the notches and an inner peripheral wall of the second panel frame, and the air baffle rib being arranged at the second panel frame.

3. The panel assembly according to claim 1, wherein the air guide plate is one of a plurality of air guide plates each provided at one of the plurality of air outlets and rotatable to open and close, and the rotation shaft of each of the air guide plates is located on a side of the corresponding air outlet adjacent to the panel.

4. The panel assembly according to claim 1, wherein the air baffle rib is one of a plurality of air baffle ribs spaced apart from each other and provided at a side of the plurality of air outlets away from the panel.

5. The panel assembly according to claim 4, wherein a width of each of the air baffle ribs is less than or equal to 3 mm, and a spacing between adjacent ones of the air baffle ribs is less than or equal to 5 mm.

6. The panel assembly according to claim 1, wherein the air baffle rib is in a ring shape surrounding the panel, and the air baffle rib surrounds an outer side of the plurality of air outlets.

7. The panel assembly according to claim 1, wherein the air guide plate is provided with a windless-feeling perforation.

8. The panel assembly according to claim 1, wherein the panel is provided with an air inlet.

9. The panel assembly according to claim 8, wherein the panel is integrated with an air inlet grille at the air inlet.

10. The panel assembly according to claim 1, wherein:

the panel frame includes:

a first panel frame in annular shape and fitted over an outer circumference of the panel; and a second panel frame in annular shape and fitted over an outer circumference of the first panel frame, and the air baffle rib being arranged at the second panel frame; and the lowermost point of the appearance surface of the panel frame in the vertical direction is a lowermost point of the second panel frame in the vertical direction.

11. The panel assembly according to claim 1, wherein:

the panel frame includes:

a first panel frame in annular shape and fitted over an outer circumference of the panel; and a second panel frame in annular shape and fitted over an outer circumference of the first panel frame, and the air baffle rib being arranged at the second panel frame; and a distance between the rotation shaft and the first panel frame in a horizontal direction is less than a distance between the rotation shaft and the second panel frame in the horizontal direction.

12. A ceiling-embedded air conditioner comprising:

a panel assembly including:

a panel;

a panel frame in annular shape and fitted over the panel, the panel frame including:

a plurality of air outlets spaced apart from each other and surrounding the panel; and an air baffle rib provided at an appearance surface of the panel frame and located on a side of the plurality of air outlets away from the panel; and an air guide plate movably arranged at the plurality of air outlets, and including a rotation shaft, the rotation shaft being located at a position lower than a lowermost point of the appearance surface of the panel frame in a vertical direction;

wherein the air baffle rib is configured to prevent airflow outputting radially at one of the plurality of air outlets from directly blowing to the appearance surface of the panel frame in response to the air guide plate moving to a direction parallel to a plane where the panel is located.

13. The ceiling-embedded air conditioner according to claim 12, wherein the panel frame includes:

a first panel frame in annular shape and fitted over an outer circumference of the panel, a plurality of notches spaced apart from each other being arranged at an outer edge of the first panel frame; and a second panel frame in annular shape and fitted over an outer circumference of the first panel frame, each of the plurality of air outlets being formed between an inner wall of one of the notches and an inner peripheral wall of the second panel frame, and the air baffle rib being arranged at the second panel frame.

14. The ceiling-embedded air conditioner according to claim 12, wherein the air guide plate is one of a plurality of air guide plates each provided at one of the plurality of air outlets and rotatable to open and close, and the rotation shaft of each of the air guide plates is located on a side of the corresponding air outlet adjacent to the panel.

15. The ceiling-embedded air conditioner according to claim 12, wherein the air baffle rib is one of a plurality of air baffle ribs spaced apart from each other and provided at a side of the plurality of air outlets away from the panel.

16. The ceiling-embedded air conditioner according to claim 15, wherein a width of each of the air baffle ribs is less than or equal to 3 mm, and a spacing between adjacent ones of the air baffle ribs is less than or equal to 5 mm.

17. The ceiling-embedded air conditioner according to claim 12, wherein the air baffle rib is in a ring shape surrounding the panel, and the air baffle rib surrounds an outer side of the plurality of air outlets.

18. The ceiling-embedded air conditioner according to claim 12, wherein the air guide plate is provided with a windless-feeling perforation.

19. The ceiling-embedded air conditioner according to claim 12, wherein the panel is provided with an air inlet.

20. The ceiling-embedded air conditioner according to claim 19, wherein the panel is integrated with an air inlet grille at the air inlet.

* * * * *